US007726998B2

(12) United States Patent
Siebens

(10) Patent No.: US 7,726,998 B2
(45) Date of Patent: Jun. 1, 2010

(54) LOCKING PIN

(75) Inventor: Larry Norman Siebens, Asbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/482,762

(22) Filed: Jun. 11, 2009

(65) Prior Publication Data

US 2010/0015834 A1 Jan. 21, 2010

Related U.S. Application Data

(60) Provisional application No. 61/135,186, filed on Jul. 17, 2008.

(51) Int. Cl.
*H01R 13/62* (2006.01)

(52) U.S. Cl. ..... 439/299

(58) Field of Classification Search ..... 439/299, 439/300, 731
See application file for complete search history.

(56) References Cited

U.S. PATENT DOCUMENTS

| | | | | |
|---|---|---|---|---|
| 2,431,268 | A | 11/1947 | McIntyre | |
| 3,369,215 | A * | 2/1968 | Haegert | 439/764 |
| 3,390,897 | A | 7/1968 | Moore | |
| 3,796,448 | A | 3/1974 | Ringkamp | |
| 3,822,074 | A | 7/1974 | Welcker | |
| 3,829,136 | A | 8/1974 | Eidelberg | |
| 4,025,049 | A | 5/1977 | Schmidt | |
| 4,114,971 | A * | 9/1978 | Heimbrock | 439/596 |
| 4,288,114 | A | 9/1981 | Hansen | |
| 5,083,883 | A | 1/1992 | Ueda et al. | |
| 5,255,993 | A | 10/1993 | Kovacs | |
| 5,316,492 | A | 5/1994 | Schaareman | |
| 5,829,480 | A | 11/1998 | Smith, III | |
| 6,494,495 | B1 | 12/2002 | Cunningham | |
| 6,672,849 | B1 | 1/2004 | Martindale et al. | |
| 6,851,829 | B2 * | 2/2005 | Wu | 439/299 |
| 7,101,232 | B2 * | 9/2006 | Shimizu | 439/731 |
| 7,243,958 | B2 | 7/2007 | Williams | |
| 2005/0074999 | A1 * | 4/2005 | Ohara | 439/299 |
| 2007/0262582 | A1 * | 11/2007 | Williams | 285/404 |

* cited by examiner

*Primary Examiner*—Chandrika Prasad
(74) *Attorney, Agent, or Firm*—Hoffmann & Baron, LLP

(57) ABSTRACT

A high voltage electrical connector that includes a male interconnect, a female interconnect and a locking pin assembly. The male interconnect includes a contact pin with a locking groove and the female interconnect includes a socket with an axial bore, a transverse passage and an opening connecting the bore to the passage. The locking pin assembly is installed in the passage and has a recessed section and a cylindrical section. The locking pin assembly is movable between a first position, wherein the bore is unobstructed and the contact pin can be freely inserted and removed, and a second position, wherein the cylindrical section of the locking pin extends into the bore. After the contact pin is inserted in the bore and the locking groove aligned with the opening, the locking pin assembly is moved from the first position to the second position and secures the contact pin in the socket.

20 Claims, 8 Drawing Sheets

LOCKING PIN

This application claims priority from provisional application Ser. No. 61/135,186, filed on Jul. 17, 2008, which is incorporated herein in its entirety.

FIELD OF THE INVENTION

The present invention relates to separable electrical connectors and more particularly to improvements in separable electrical connectors such as high voltage connectors with features for securing a contact pin in the connector.

BACKGROUND OF INVENTION

High voltage power cables are typically connected to a yoke or bus bar using a connector, such as a receptacle or a separable cable joint. Generally, these connectors are 2-way, 3-way and 4-way disconnectable splice connectors. Most of the connectors currently being used employ a spade type connector or lug with a flat washer, disc spring and a bolt to make the connection. Generally, the cable joints are sold in kits or packages that include an insulated bus bar, straight receptacle housings, retaining rings, cable size adapters, lugs, bolts and washers. After the components are assembled, the bolt is torqued to a specified value of between 55 and 60 foot pounds. However, most users don't always have the necessary torque tools for the assembly and, therefore, there is no way to ensure proper assembly. In some cases, manufacturers provide torque limiting bolts with the connectors so that the joint can be assembled to the correct torque without using a torque tool.

Accordingly, there is a need for a connector for a high voltage cable that can be quickly and easily installed without the need for torque tools or other devices to properly install the connector.

SUMMARY OF THE INVENTION

In accordance with the present invention, a high voltage electrical connector is provided for connecting a high voltage cable to a bus bar. In a first embodiment, the high voltage electrical connector includes a male interconnect, a female interconnect and a locking pin. The male interconnect includes a contact pin with a locking groove. Preferably, the contact pin is substantially cylindrical and has a first end, a mid-section and a second end. The second end of the contact pin can be connected to a crimp barrel, which is connected to either the high voltage cable or the bus bar. The female interconnect includes a socket having a closed end, an open end and a bore that extends between the two ends. The socket is connected to the other of the high voltage cable or the bus bar and adapted to receive the contact pin. The female interconnect also includes a passage that extends through the socket and transversely to the bore and an opening connecting the bore to the passage. The bore and the passage can have substantially round shapes and the opening between them can have a substantially elliptical shape.

The locking pin is preferably part of a locking pin assembly that also includes a shoulder bolt and a compression spring. The locking pin assembly has a recessed section that can have a concave shape and a non-recessed section, which is preferably cylindrical in shape. The recessed section of the locking pin assembly is preferably formed in the locking pin. The shoulder bolt is coupled to the locking pin and the compression spring is intermediate the shoulder bolt and the locking pin. The shoulder bolt can have a bolt head end and a threaded end and the locking pin can have a cavity on one end. Preferably, the shoulder bolt is threadably coupled to the locking pin.

The locking pin assembly is installed in the passage of the socket. When the concave section of the locking pin assembly is aligned with the opening between the passage and the bore, the contact pin can be inserted into and removed from the socket. When the contact pin is inserted in the socket and the locking groove is aligned with the opening, the non-recessed section of the locking pin assembly is aligned with the opening to lock the contact pin in the socket. In a preferred embodiment, a portion of the locking pin assembly (either the shoulder bolt or the locking pin) extends into the bore when the compression spring is not compressed and obstructs the movement of the contact pin in the bore. When the compression spring is compressed, the recessed section of the locking pin assembly aligns with the opening and the locking pin does not extend into the bore. This allows the contact pin unrestricted movement in the bore.

The passage in the socket has a first cross-sectional dimension and an orifice, which has a second cross-sectional dimension that is less than the first cross-sectional dimension. Preferably, the passage and the orifice have a substantially round cross-section and the cross-sectional dimensions are diameters. The shoulder bolt is inserted through the orifice and coupled to the locking pin so that the compression spring is retained in a position intermediate the shoulder bolt and the locking pin.

The shoulder bolt can have a bolt head with a first diameter on a first end and a threaded second end. Preferably, the locking pin has a non-recessed section that can be substantially cylindrical in shape and have a second diameter. The locking pin can also have a cavity on one end. Preferably, the shoulder bolt is inserted in the cavity and threadably coupled to the locking pin. The recessed section of the locking pin is preferably concave and extends around the circumference of the locking pin. Preferably, the first and second diameters of the bolt head and locking pin, respectively, are greater than the second cross-sectional dimension of the orifice but less than the first cross-sectional dimension of the passage. This allows the bolt head and locking pin to be inserted in the passage but prevents the bolt head and locking pin from passing all of the way through the passage. When the locking pin locks the contact pin in the socket, the cylindrical section of the locking pin snugly fits in the groove of the contact pin.

The locking pin assembly is movable between a first position, wherein the recessed section is aligned with the opening so that the locking pin assembly does not extend into the bore, and a second position, wherein the non-recessed section of the locking pin assembly extends through the opening and into the bore. When the locking pin assembly is in the first position, the contact pin can be inserted into and removed from the socket. When the contact pin is inserted in the socket and the locking groove is aligned with the opening, the locking pin assembly can be moved into the second position to lock the contact pin in the socket.

The connector is assembled by applying a force to the locking pin assembly to move the concave section of the locking pin assembly into alignment with the opening between the bore and the passage. The contact pin is inserted into the bore in the socket until the locking groove aligns with the opening. The pressure on the locking pin assembly is then released so that the compression spring moves the cylindrical section into alignment with the opening.

In a second embodiment of the high voltage electrical connector for connecting a cable to a bus bar, the connector includes a crimp barrel, a collar, a contact pin and a socket.

The crimp barrel has a first end that is electrically coupled to either the cable or the bus bar and the second end that has a tubular neck. The tubular neck has an exterior surface, a first end and a second end connected to the first end of the crimp barrel. The collar has a threaded interior wall and is slidably and rotatably installed on the tubular neck. The contact pin has a first end, which is preferably tapered, and a second end that is in electrical engagement with the first end of the tubular neck.

The socket has a first end, a second end and a bore extending between the first end and the second end. The first end is electrically coupled to the other of the cable or bus bar i.e., if the crimp barrel is connected to the cable then the socket is connected to the bus bar and vice versa. The socket has an interior surface defined by the bore and the second end has a threaded exterior surface. The interior surface of the socket can have a plurality of flexible louvers. The connector is assembled by inserting the first end of the contact pin into the bore of the socket, sliding the threaded collar over the threaded exterior surface of the socket and rotating the collar to threadably couple the collar onto the second end of the socket. The tubular neck can have a retaining ring extending circumferentially around the exterior surface, which allows the collar to rotate freely on the tubular neck and slidably move between the crimp barrel and the retaining ring.

BRIEF DESCRIPTION OF THE FIGS.

The preferred embodiments of the locking pin for the high voltage electrical connectors of the present invention, as well as other objects, features and advantages of this invention, will be apparent from the accompanying drawings wherein.

DETAILED DESCRIPTION OF THE INVENTION

Figure 1:
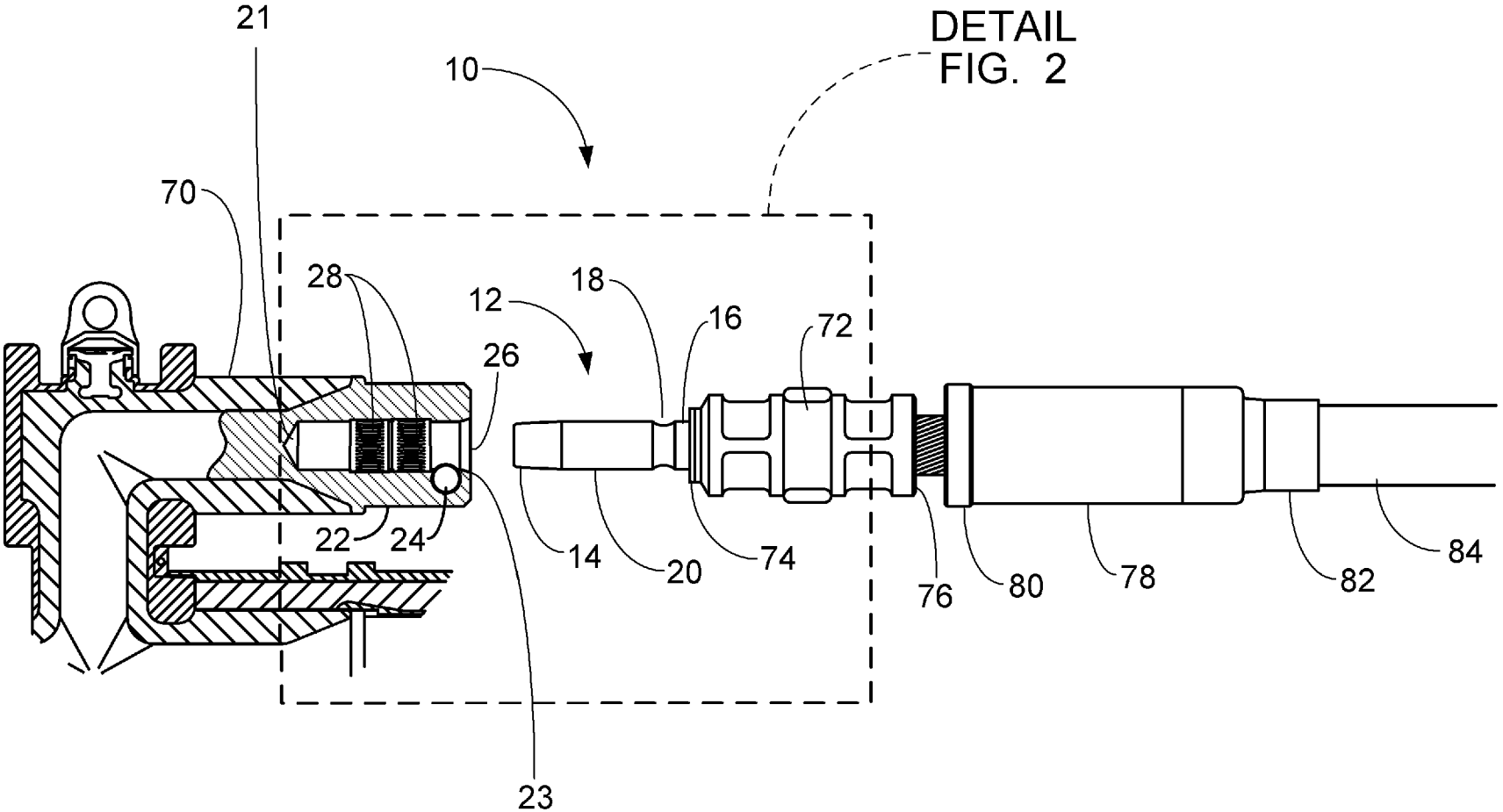
FIG. 1 is a sectional side view of a first embodiment of a connector of the present invention with a locking pin.

The present invention is directed to high voltage electrical connectors having interconnecting male and female components that allow a user to make a connection without the need for a torque tool or torque limiting bolt. The male interconnect and the female interconnect components of the connectors connect to each other on one end and the other end of each component can be connected to either a cable, a bus bar or an electrical device.

In one embodiment of the high voltage electrical connector, the male interconnect includes a substantially cylindrical contact pin having a first end, a mid-section, a second end and a locking groove. The female interconnect includes a socket having a first end, a second end and a bore that extends inwardly from the second end and has a longitudinal axis, a passage extending transversely to the longitudinal axis and an opening connecting the bore to the passage. The passage has a first diameter and an orifice and the orifice has a second diameter that is less than the first diameter. The connector also has a locking pin assembly associated with the female interconnect that has a concave mid-section intermediate the opposing ends. The locking pin assembly includes a shoulder bolt having a threaded end, a compression spring and a locking pin coupled to the shoulder bolt.

The locking pin assembly is assembled to extend through the passage with the opposite ends of the shoulder bolt and the locking pin being on opposite sides of the orifice to secure the locking pin assembly in the passage. The connector is assembled by applying a force to the locking pin assembly to move the concave section of the locking pin assembly into alignment with the opening between the bore and the passage, inserting the contact pin in the bore in the socket until the locking groove aligns with the opening and releasing the pressure from the locking pin assembly so that the compression spring moves the concave mid-section away from the opening. The non-recessed section of the locking pin assembly passes through the opening and into the locking groove to secure the contact pin in the socket.

In another embodiment, the high voltage electrical connector for connecting a cable to a bus bar, the male interconnect includes a crimp barrel, a threaded collar and a contact pin. The crimp barrel has a first end and a second end, wherein the first end is electrically coupled to one of the cable or bus bar and the second end has a tubular neck with an open end extending from the crimp barrel and a retaining ring proximate the open end. The threaded collar has a threaded interior wall and is installed over the tubular neck. The threaded collar slidably moves along the tubular neck and the retaining ring retains the collar on the tubular neck. The contact pin has a first end and a second end that is in electrical engagement with the tubular neck.

The female interconnect includes a socket having a first end, a second end and a bore that has a longitudinal axis and extends inwardly from the second end. The first end is electrically coupled to the other of the cable or bus bar and the second end has an exterior surface with a plurality of threads. The connector is assembled by inserting the first end of the contact pin into the bore of the socket, sliding the threaded collar over the plurality of threads on the socket and rotating the collar to secure the collar on the second end of the socket.

In a typical high voltage connector, the current path is from a cable through a crimp barrel to a contact pin or lug, which connects to a bus bar socket. Various methods are used for securing the contact pin in the socket. The first embodiment of the present invention includes a locking pin assembly that has a recessed section and includes a locking pin, a compression spring and a shoulder bolt. The bus bar socket has a bore that extends inwardly from the open end along the longitudinal axis of the socket and a transverse passage extending through the socket. The bore is connected to the passage by an opening. The socket can have louver-type contacts and is designed to receive the portion of the contact pin extending from the crimp barrel. The contact pin has a substantially cylindrical shape and a locking groove that circumferentially extends in a band on the outer surface.

The locking pin assembly is installed in a passage that extends through the bus bar and transverse to the axis of the bore in the socket. As used herein, the term transverse (or transversely) means that the longitudinal axis of the bore and the longitudinal axis of the passage are substantially perpendicular to each other. The passage can be a substantially round bore that is preferably located at a point near the open end of the bore and intersects the socket in a manner so that only a portion of the passage intersects the bore. Preferably, between one-eighth and three-quarters of the diameter of the passage intersects the bore. This intersection forms an opening, preferably an elliptical opening, between the passage and the bore. The diameter of the passage is substantially uniform along its length, except on one side of the opening where an orifice with a reduced diameter is located. The reduced diameter of the orifice limits the travel of the locking pin in the passage as is explained in more detail below. Although the passage preferably has a round bore, those skilled in the art will appreciate that the passage can have other cross-sectional shapes, such as square, rectangular or oval. For the present disclosure, the passage is described as having a substantially round cross-section. However, other cross-sectional shapes are within the scope of this invention.

In a preferred embodiment, the locking pin is generally cylindrical in shape and has a cavity in the first end with a threaded aperture at the base of the cavity. The mid-section of the locking pin is preferably more than one-third of the total length and is recessed, preferably concave, with a diameter less than the diameters of the opposing ends. In other embodiments, the concave mid-section of the locking pin assembly is formed in the shoulder bolt. The first and second ends of the locking pin have outer diameters that are slightly less than the diameter of the passage but greater than the diameter of the orifice in the passage. This allows the locking pin to be slidably received in either end of the passage but the orifice prevents the locking pin from passing through to the other end. The locking pin is preferably constructed of a metal, such as aluminum, brass or steel.

The locking pin is part of an assembly that also includes a compression spring and a shoulder bolt. The compression spring can have a helical shape and is sized to fit over the shaft of the shoulder bolt and inside the cavity in the first end of the locking pin. The shaft of the shoulder bolt has two diameters: a first unthreaded portion with a larger diameter extending from the bolt head to a point intermediate the two ends and a second threaded portion with a smaller diameter that extends from the unthreaded portion to the end of the bolt. The larger diameter of the shaft is smaller than the diameter of the orifice in the passage. When the locking pin assembly is installed in the passage, the threaded portion of the bolt is inserted through the orifice from one end of the passage and the compression spring and locking pin are then inserted from the other end of the passage. The second end of the locking pin is pressed in to compress the spring and the threaded end of the bolt is received in the cavity of the locking pin. The bolt is rotated to screw the threaded end of the bolt into the threaded aperture at the base of the cavity and secure the compression spring and locking pin in the passage. The shoulder bolt is sized so that the compression spring is not compressed or only slightly compressed when the bolt is connected to the locking pin.

Pressing the locking pin in from the second end allows the locking pin assembly to slidably move toward the opposing end of the passage so that the concave mid-section is aligned with the opening that connects the passage to the bore in the socket. The concave portion of the locking pin assembly is designed so that it does not extend into the bore of the socket and does not interfere with the movement of the contact pin in the bore. When the pressure on the locking pin assembly is released, the compression spring returns the locking pin assembly to its original position, wherein a substantial portion of the locking pin assembly, preferably the locking pin, is positioned in the opening that connects the passage to the bore and interferes with the movement of the contact pin in the bore.

In another embodiment, the concave mid-section of the locking pin assembly is formed in the shoulder section of the shoulder bolt. The shoulder bolt is installed from one side of the orifice in the passage and connects to the locking pin on the other side of the orifice. A compression spring located between the locking pin and the orifice compressively retains the shoulder bolt so that the concave mid-section is not aligned with the opening between the passage and the bore of the socket. However, applying a force to the locking pin slidably moves the shoulder bolt so that the concave mid-section is aligned with the opening. This allows the contact pin to freely move into and out of the bore in the socket.

The contact pin that is used with the locking pin has a first end that is inserted into the bore of the socket and a second end that is secured in the crimp barrel. The contact pin has a substantially cylindrical shape and is preferably tapered at the first end (and most preferably both ends) to facilitate insertion into the bore and has a locking groove, preferably located near the second end. The locking groove is preferably a concave band that extends around the outside circumference of the contact pin so that the contact pin has a decreased diameter in the region of the band. When the contact pin is fully inserted in the bore of the socket, the locking groove aligns with the opening that connects the bore and the passage.

The contact pin is inserted into the bore of the socket with the second end of the locking pin pressed in so that the recessed section of the locking pin assembly is aligned with the opening between the passage and the bore. After the contact pin is inserted in the socket, the pressure on the locking pin is released and the compression spring moves the first end of the locking pin into the opening where it aligns with the locking groove to lock the contact pin in place.

The locking pin assembly is movable between a first position, wherein the recessed section is aligned with the opening and does not extend into the bore, and a second position, wherein the locking pin extends through the opening and into the bore. In the first position, the bore is unobstructed and the contact pin can be freely inserted and removed. In the second position, the locking pin assembly obstructs the bore. After the contact pin is inserted in the bore of the socket and positioned so that the locking groove aligns with the opening, the locking pin assembly is moved from the first position to the second position and snugly engages the locking groove to secure the contact pin in the socket.

The connection made using the locking pin does not require any tools since the locking pin does not need to be torqued to provide a good joint or connection. The cable can be disconnected and reconnected by applying a force to slide the locking pin assembly in the passage so that the recessed portion of the locking pin assembly is aligned with the locking groove of the contact pin. The locking pin assembly can operate repeatedly to lock and unlock the contact pin without loosing the integrity of the joint. If the contact pin is not installed fully into the socket, the locking groove does not align with the opening between the bore and the passage and the locking pin assembly will not slide back into the locking position when the pressure is released. If the locking pin assembly does not move into a locking position, the shoulder bolt will extend out of the passage, beyond the outside wall of the socket. This provides indication to the user that the contact pin is not properly connected to the socket. Preferably, the first portion of the shoulder bolt, between the bolt head and the threaded portion, is painted a bright color, such as red or yellow, so that a user has a visible indication that the shoulder bolt is not in the locking position.

In a second embodiment of the present invention, the end of the crimp barrel that receives the contact pin has a neck with a threaded collar. The threaded collar is secured to the neck by a retaining ring on the open end, which allows the collar to move along the neck and rotate freely but prevents it from moving past the open end. The outer surface of the socket has a plurality of threads for receiving the threaded collar. After the contact pin is installed in the socket, the collar is threaded onto the socket to secure the contact pin in the bore of the socket.

Figure 2:
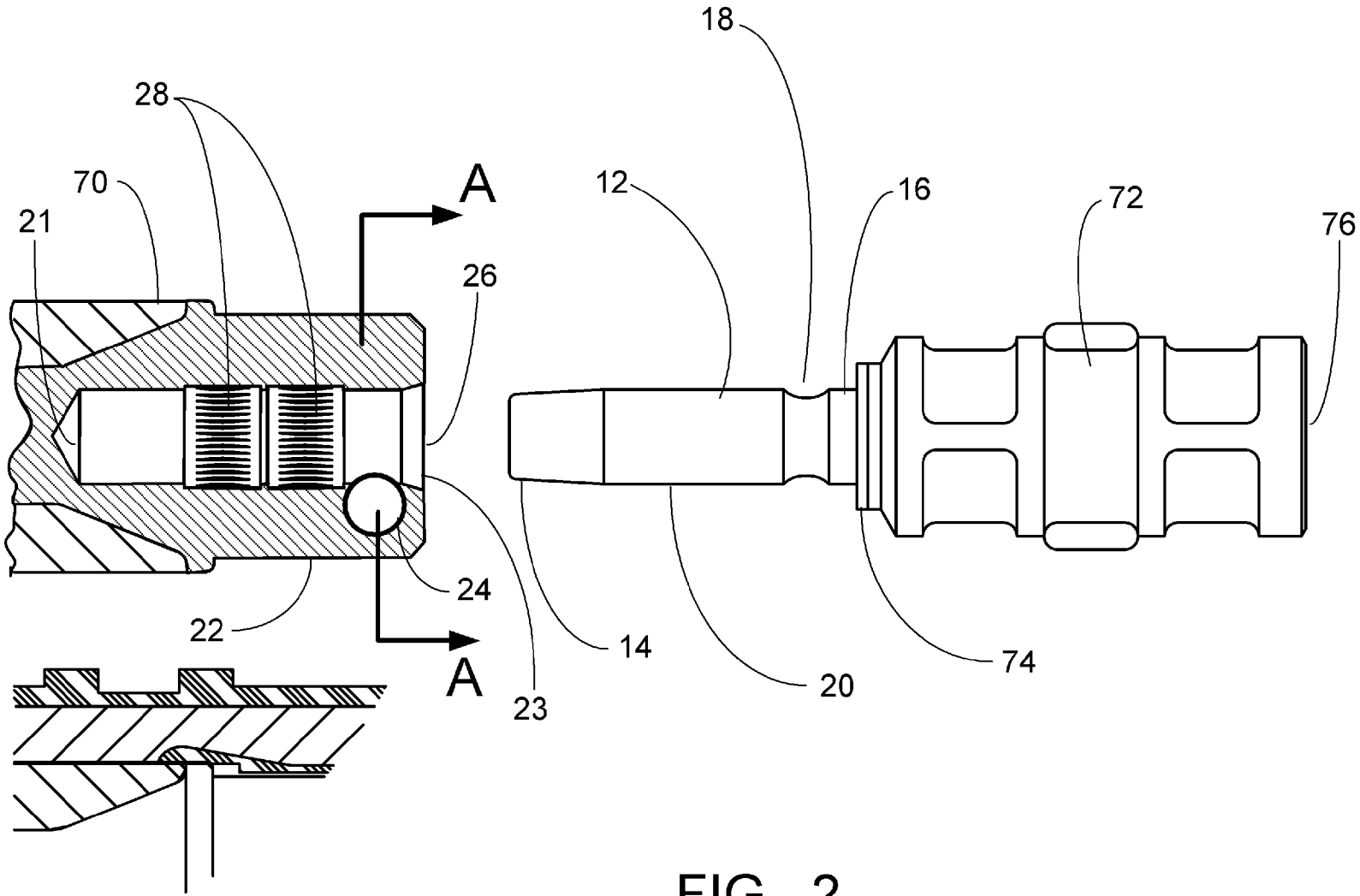
FIG. 2 is a detail of the connector with the locking pin shown in FIG. 1.

Turning now to the drawings, FIGS. 1 and 2 show the first embodiment of the connector 10 of the present invention which includes male interconnect formed by a contact pin 12 and a female interconnect formed by a socket 22 with a spring loaded locking pin assembly 24. The contact pin 12 has a first end 14 that is tapered to allow easy installation in the socket 22, a middle section 20 that contacts the inside of the socket 22 and a second end 16 that is secured in a crimp barrel 72. The contact pin 12 also has a locking groove 18 near the second end 16 that is dimensioned to slidably receive a portion of the locking pin 40 (see FIG. 3). The crimp barrel 72 is installed by first connecting a high voltage cable 84 to the first end 82 of a cable adapter 78, which connects to the first end 76 of the crimp barrel 72. The retaining ring 80 secures the cable adapter 78 to the first end 76 of the crimp barrel 72. The second end 16 of the contact pin 12 is then secured in the second end 74 of the crimp barrel 72. FIG. 1 shows the male interconnect contact pin 12 connected to a crimp barrel 72 that connects to a cable 84 and the female interconnect socket 22 connected to a bus bar 70. However, this is not a limitation and it is within the scope of the present invention for both the male interconnect contact pin 12 and the female interconnect socket 22 to be connected to a cable 84, a bus bar 70 or an electrical device (not shown).

The socket 22 of the connector 10 is connected to a high voltage bus bar 70 on the closed first end 21 and receives the contact pin 12 in a bore 26 on the open second end 23. The bore 26 of the socket 22 extends along its longitudinal axis and is sized to snugly receive the contact pin 12. The inside wall of the bore 26 has flexible louver contacts 28 that compressively contact the contact pin 12 and provide good electrical contact. The locking pin assembly 24 is installed in a passage 64 that extends transversely to the bore 26 in the socket 22 (see FIGS. 3 and 4). The passage 64 intersects a small portion of the bore 26 to form an opening 25 (see FIGS. 3 and 4) that connects the bore 26 and the passage 64.

Figure 4:
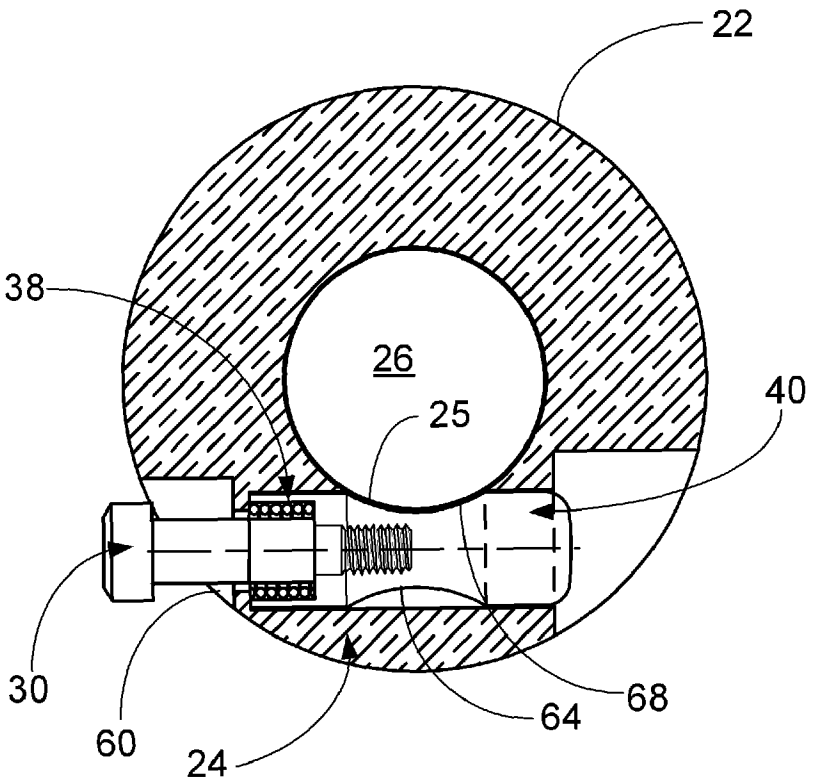
FIG. 4 is section A-A from FIG. 2 showing the locking pin in the open or "unlocked" position.
Figure 3:
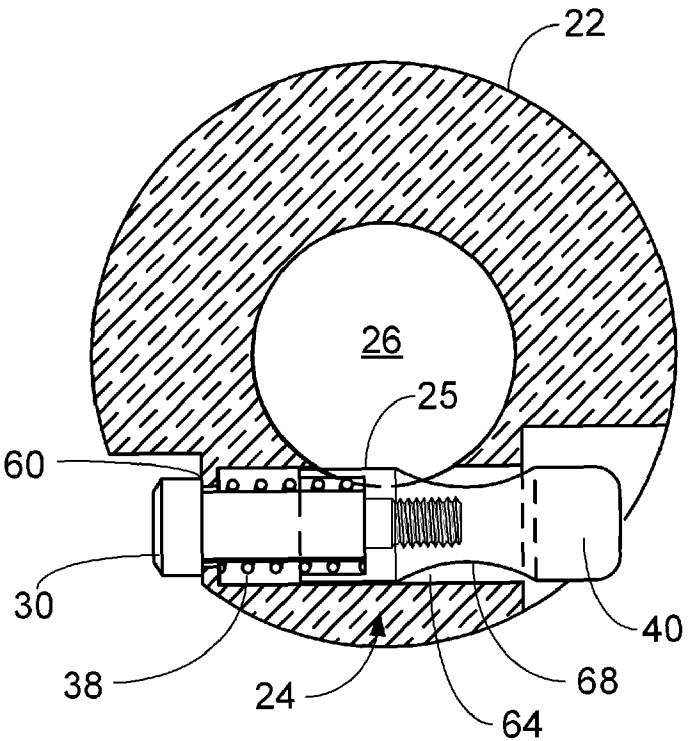
FIG. 3 is section A-A from FIG. 2 showing the locking pin in the closed or "locked" position.

FIGS. 3 and 4 show cross-section A-A from FIG. 2 of the socket 22 and the passage 64 that slidably receives the locking pin assembly 24. In FIG. 3, there is only minimal external force applied to the locking pin assembly 24 (i.e., the compression spring 38 is in a relaxed or only slightly compressed state) and the locking pin 40 is positioned so that the first end 42 of the locking pin 40 extends through the opening 25 in the socket 22 and obstructs the insertion of the contact pin 12 (FIG. 1). FIG. 4 shows the locking pin assembly 24 with a force applied to the locking pin 40 to compress the compression spring 38 so that the concave, mid-section 68 of the locking pin 40 is aligned with the opening 25 in the socket 22. In this configuration, the locking pin 40 does not obstruct the bore 26 in the socket 22 and the contact pin 12 can move freely in and out of the bore 26.

The locking pin assembly 24 includes a shoulder bolt 30, a compression spring 38 and the locking pin 40. The shoulder bolt 30 has three sections; a bolt head 32, a shoulder section 34 and a threaded end section 36. The compression spring 38 is sized to snugly fit into the passage 64 and over the threaded end section 36 and the shoulder section 34 of the shoulder bolt 30. The locking pin 40 is cylindrically shaped with a concave mid-section 48, a first end 42, with a cavity 44 and a threaded aperture 46 at the bottom of the cavity 44, and a second end 50 that can optionally have a threaded slot 52. When the locking pin assembly 24 is installed in the passage 64, the compression spring 38 and locking pin 40 are inserted in the second end 66 of the passage 64 with the spring 38 inside the cavity 44. The shoulder bolt 30 is then inserted into the first end 62 of the passage 64 and through the orifice 60. The threaded end section 36 of the shoulder bolt 30 is screwed into threaded aperture 46 in the locking pin 40 to complete the installation of the locking pin assembly 24 in the passage 64. FIG. 3 shows the locking pin assembly 24 with the compression spring 38 in a relaxed position and FIG. 4 shows the locking pin assembly 24 with the compression spring 38 in a compressed position.

Figure 5:
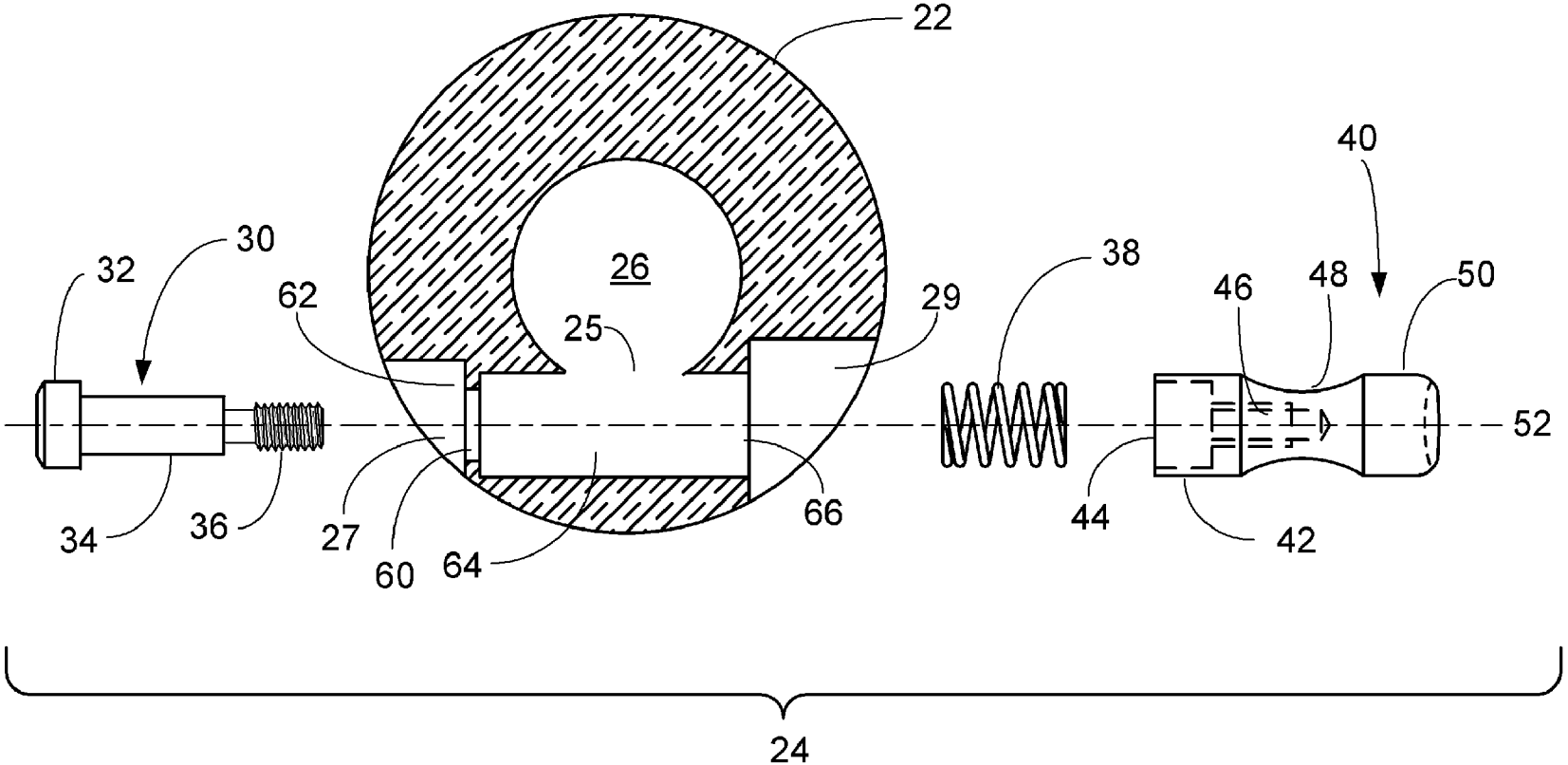
FIG. 5 is section A-A from FIG. 2 showing an exploded view of the locking pin with a shoulder bolt and compression spring.
Figure 6:
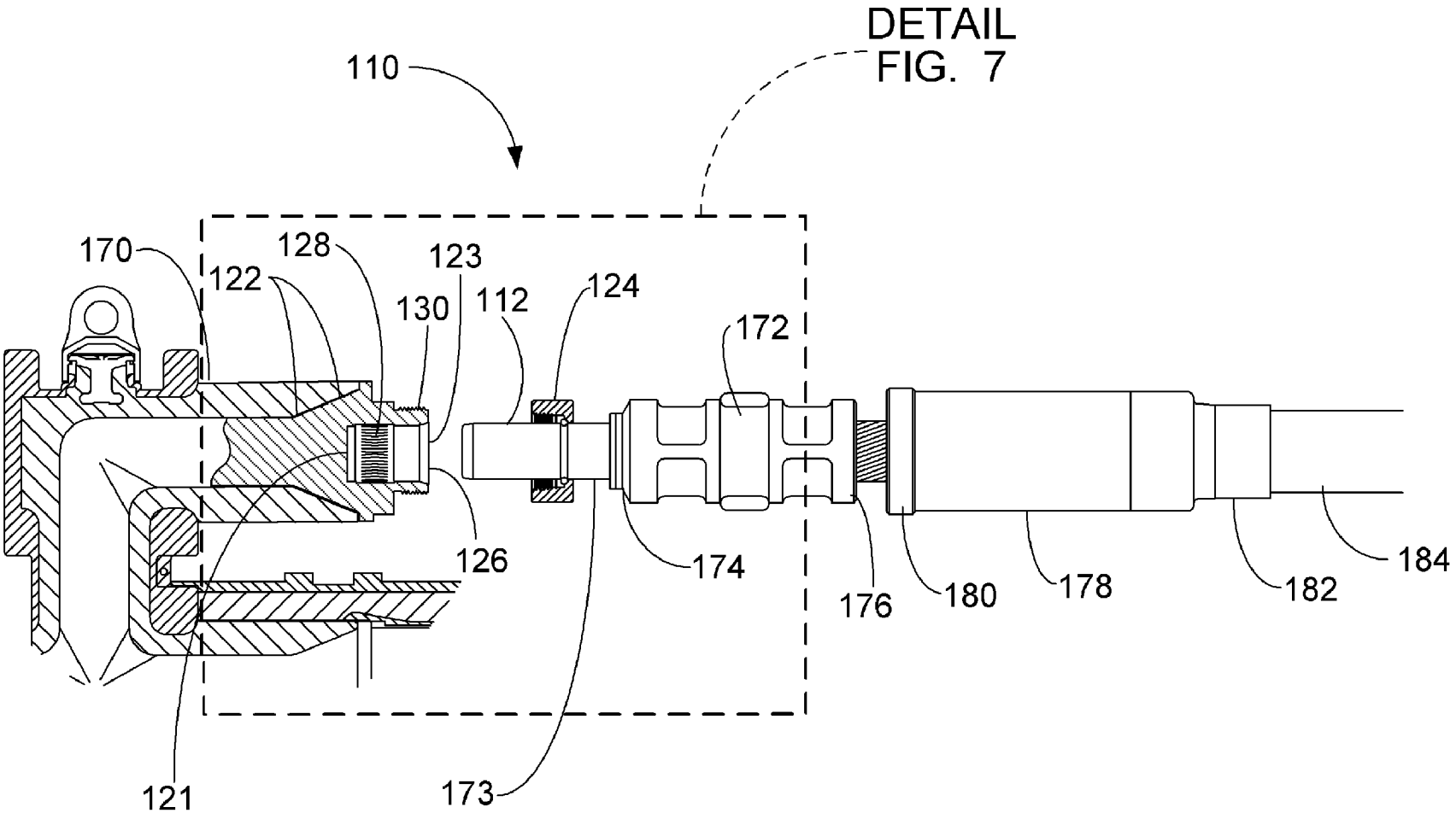
FIG. 6 is a sectional side view of a second embodiment of a connector of the present invention with a threaded collar prior to making the connection.

FIG. 5 shows an exploded view of the locking pin assembly 24 and a cross-sectional view of the socket 22. The passage 64 in the socket 22 is transversely positioned in relation to the bore 26 in the socket 22 and FIG. 5 shows that the passage 64 and the bore 26 intersect to form an opening 25 therebetween. The first end 62 and the second end 66 of the passage 64 have counter bores 27, 29 (i.e., a bore in the socket 22 that is concentric with the passage 64 but has a greater diameter) in the outer wall of the socket 22. An orifice 60 is located in the passage 64 which has a diameter that is less than the diameters of the passage 64 at the first end 62 and the second end 66. When the compression spring 38 and locking pin 40 are slidably inserted into the second end 66 of the passage 64, their travel through the passage 64 is limited by the reduced diameter of the orifice 60. On the opposing first end 62 of the passage 64, the threaded end section 36 and the shoulder section 34 of the shoulder bolt 30 pass through the orifice 60 but the diameter of the bolt head 32 is too large to pass through the orifice 60.

Figure 7:
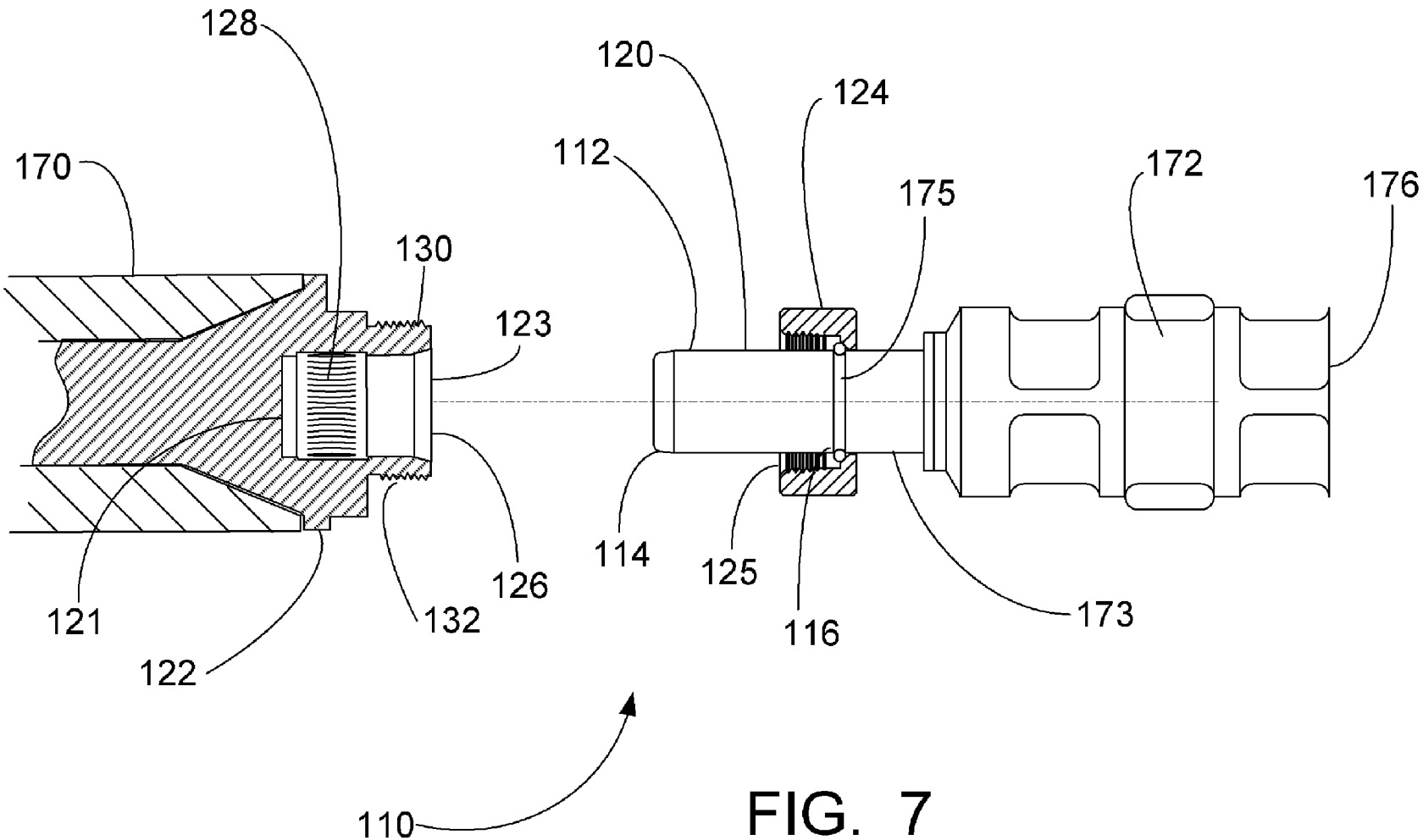
FIG. 7 is a detail of the connector with the threaded collar shown in FIG. 6.

FIGS. 6-9 show the second embodiment of the connector 110 which includes a threaded collar 124 that connects to threads 130 on the outside wall 132 of the second end 123 of the socket 122. FIG. 7 shows a high voltage cable 184 connected to the first end 182 of an adapter 178 and the second end 180 of the adapter 178 connected to the first end 176 of the crimp barrel 172. A tubular neck 173 is installed in the second end 174 of the crimp barrel 172 and a contact pin 112 is installed in the opposite end of the tubular neck 173. The tubular neck 173 has a rotatable, threaded collar 124 secured in place by a retaining ring 175 near the second end 174 of the tubular neck 173. The threaded collar 124 can freely rotate and move along the tubular neck 173 between the crimp barrel 172 and the retaining ring 175.

The first end 114 of the contact pin 112 is tapered for easy insertion into the socket bore 126 and the mid-section 120 is sized to snugly fit into and electrically contact the inside wall of the socket bore 126. The second end 116 of the contact pin 112 is secured in the second end 174 of the crimp barrel 172 so that the threads 125 on the interior wall of the threaded collar 124 extend over the retaining ring 175 and towards the first end 114 of the contact pin 112. The socket 122 is connected to a high voltage bus bar 170 on the first end 121 and receives the contact pin 112 in a bore 126 on the second end 123. The inside wall of the socket bore 126 has a plurality of flexible louvers 128 for conductively receiving the contact pin 112 and securing it in the socket 122. The receiving end 123 of the socket 122 that receives the contact pin 112 is cylindrically shaped with a plurality of threads 130 on the outside wall 132, which engage the threads 125 of the collar 124.

After the contact pin 112 is inserted in the socket 122, the threaded collar 124 is moved towards the socket 122 and rotated to thread the collar 124 onto the threads 130 on the end 123 of the socket 122. This secures the contact pin 112 in the socket 122.

Figure 8:
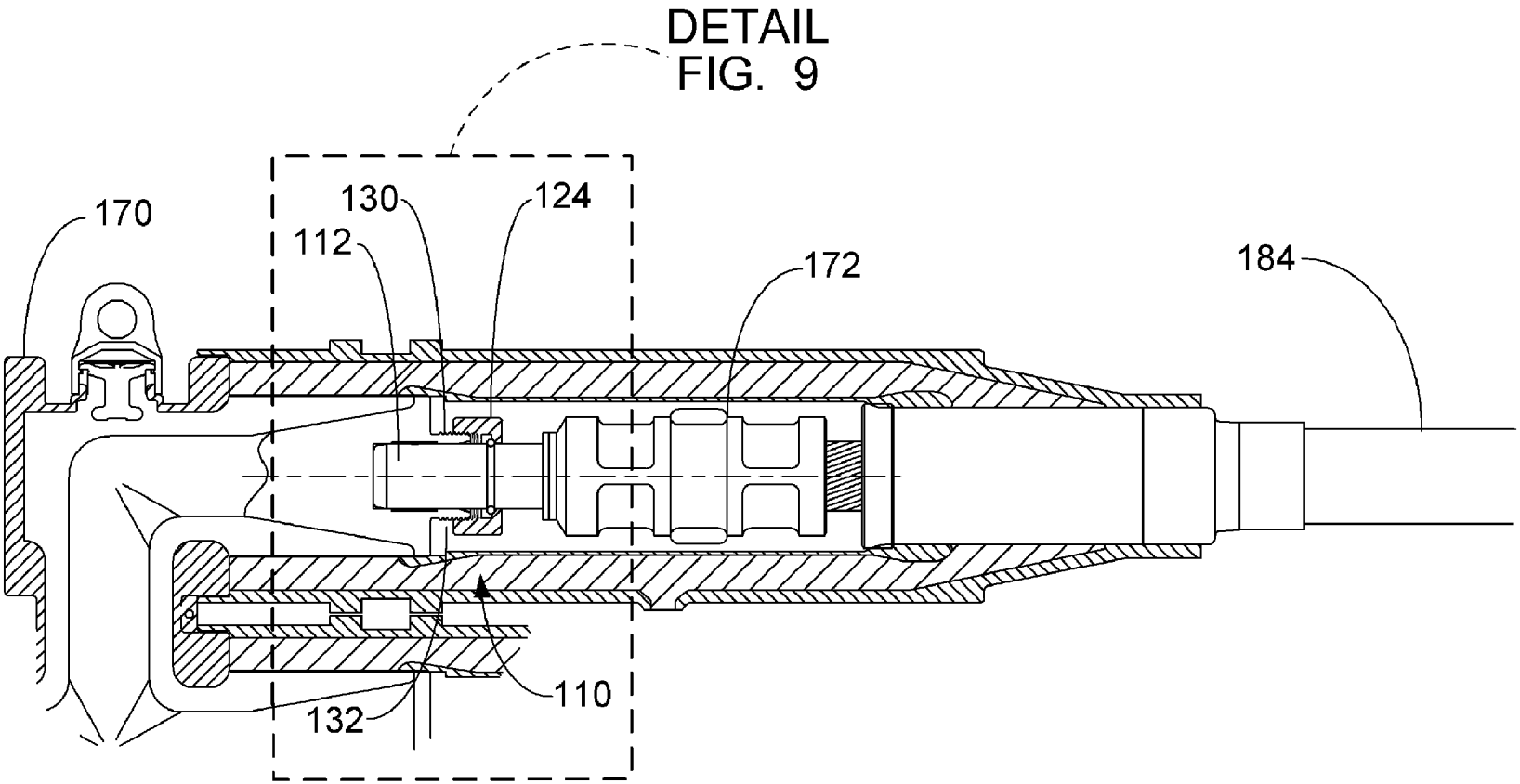
FIG. 8 is a sectional side view of a second embodiment of a connector of the present invention with a threaded collar after the connection is made.
Figure 9:
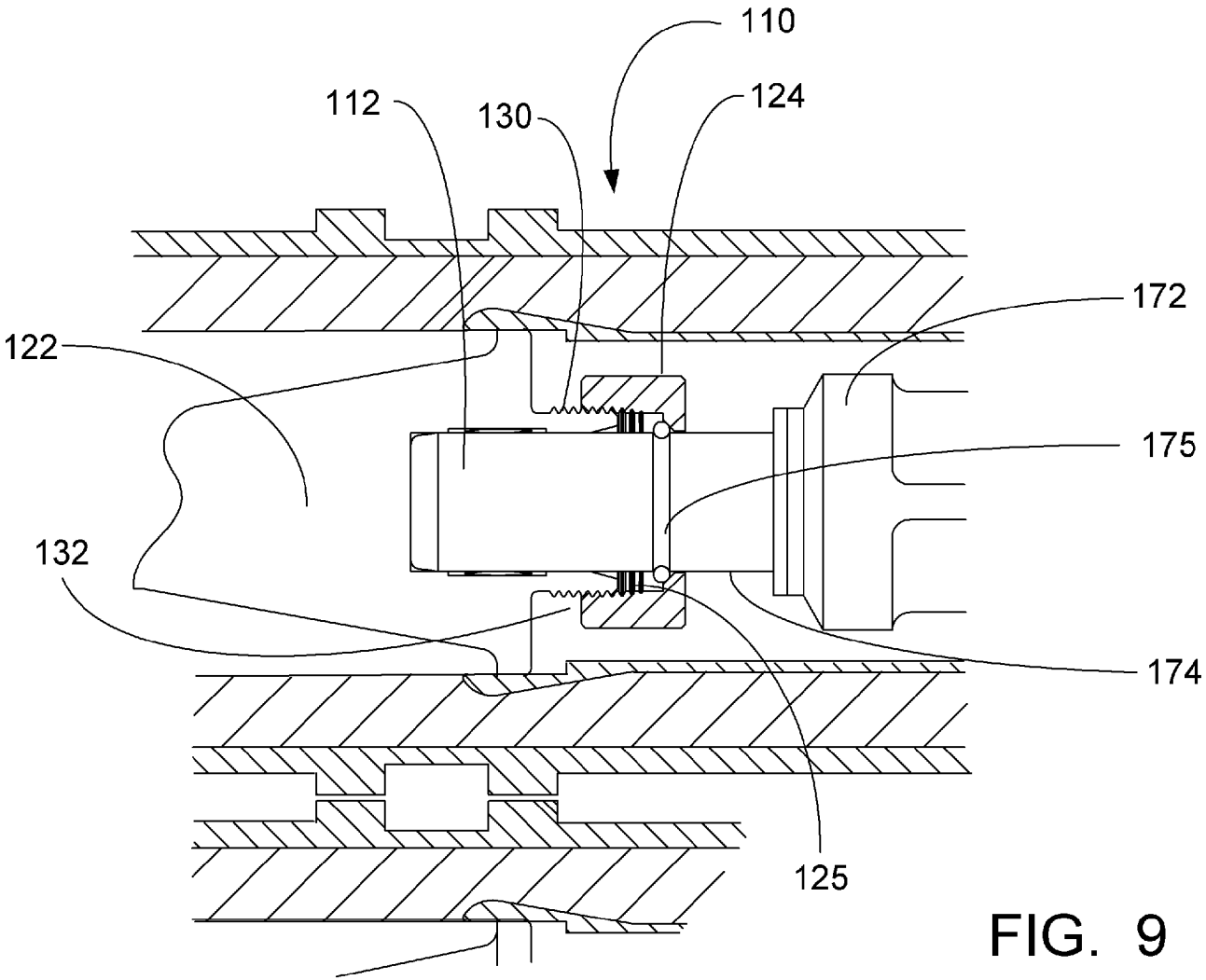
FIG. 9 is a detail of the connector with the threaded collar shown in FIG. 8.

FIGS. 8 and 9 show the threaded collar 124 threaded onto the end 123 of the socket 122 to connect a cable 184 to the high voltage bus bar 170. FIG. 9 is a detail of the threaded collar 124 connected to the end 123 of the socket 122. The collar 124 is secured to the tubular neck 174 by the retaining ring 175.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. A high voltage electrical connector having separable male and female interconnects, the high voltage electrical connector comprising:

a male interconnect comprising a contact pin having a locking groove;

a female interconnect comprising a socket having a closed end, an open end and a bore that extends between the two ends, a passage extending through the socket and transversely to the bore and an opening connecting the bore to the passage, wherein the socket is adapted to receive the contact pin; and a locking pin having a recessed section, wherein the locking pin is installed in the passage and is movable between a first position, wherein the recessed section is aligned with the opening and does not extend into the bore, and a second position, wherein the locking pin extends through the opening and into the bore, wherein, when the locking pin is in the first position, the contact pin can be inserted into and removed from the socket and wherein, when the contact pin is inserted in the socket and the locking groove is aligned with the opening, the locking pin is moved into the second position to lock the contact pin in the socket.

2. The high voltage electrical connector according to claim 1, further comprising a locking pin assembly comprising a shoulder bolt, a compression spring and the locking pin, wherein the shoulder bolt is coupled to the locking pin, and wherein the compression spring is intermediate the shoulder bolt and the locking pin.

3. The high voltage electrical connector according to claim 1, wherein the passage has a first cross-sectional dimension and an orifice, and wherein the orifice has a second cross-sectional dimension that is less than the first cross-sectional dimension.

4. The high voltage electrical connector according to claim 3, further comprising a locking pin assembly comprising a shoulder bolt, a compression spring and the locking pin, wherein the shoulder bolt is inserted through the orifice and coupled to the locking pin, and wherein the compression spring is intermediate the shoulder bolt and the locking pin.

5. The high voltage electrical connector according to claim 4, wherein the locking pin extends into the bore when the compression spring is not compressed, and wherein the recessed section aligns with the opening and the locking pin does not extend into the bore when the compression spring is compressed.

6. The high voltage electrical connector according to claim 4, wherein the shoulder bolt has a bolt head end and a threaded end, wherein the locking pin has a cavity on one end, and wherein the shoulder bolt is threadably coupled to the locking pin.

7. The high voltage electrical connector according to claim 4, wherein the shoulder bolt comprises a bolt head having a first diameter and the locking pin has a second diameter, and wherein the first and second diameters are greater than the second cross-sectional dimension.

8. The high voltage electrical connector according to claim 1, wherein the locking pin is substantially cylindrical in shape and the recessed section is concave and extends around the circumference of the locking pin.

9. The high voltage electrical connector according to claim 1, wherein the bore and the passage have substantially round shapes and the opening has a substantially elliptical shape.

10. The high voltage electrical connector according to claim 1, wherein, when the contact pin is locked in the socket, the locking pin snugly fits in the groove.

11. A high voltage electrical connector having separable male and female interconnects, the high voltage electrical connector comprising:

a male interconnect comprising a substantially cylindrical contact pin having a first end, a mid-section, a second end and a locking groove;

a female interconnect comprising a socket having a first end, a second end and a bore that extends inwardly from the second end and has a longitudinal axis, a passage extending transversely to the longitudinal axis and an opening connecting the bore to the passage, wherein the passage has an orifice; and a locking pin assembly having a cylindrical section and a concave section and comprising a shoulder bolt, a compression spring and a locking pin, wherein the shoulder bolt is coupled to the locking pin, and wherein the compression spring and the orifice are intermediate the shoulder bolt and the locking pin, wherein, when the concave section of the locking pin assembly is aligned with the opening, the contact pin can be inserted into and removed from the socket and wherein, when the contact pin is inserted in the socket and the locking groove is aligned with the opening, the cylindrical section of the locking pin assembly is aligned with the opening to lock the contact pin in the socket.

12. The high voltage electrical connector according to claim 11, wherein the locking pin includes the concave section and the cylindrical section of the locking pin assembly.

13. The high voltage electrical connector according to claim 11, wherein the passage has a first diameter and the orifice has a second diameter that is less than the first diameter.

14. The high voltage electrical connector according to claim 11, wherein the shoulder bolt has a bolt head end and a threaded end, wherein the locking pin has a cavity on one end, and wherein the shoulder bolt is inserted in the cavity and threadably coupled to the locking pin.

15. The high voltage electrical connector according to claim 11, wherein, when the locking pin locks the contact pin in the socket, the cylindrical section of the locking pin snugly fits in the groove of the contact pin.

16. The high voltage electrical connector according to claim 11, wherein the connector is assembled by applying a force to the locking pin assembly to move the concave section of the locking pin assembly into alignment with the opening between the bore and the passage, inserting the contact pin in the bore in the socket until the locking groove aligns with the opening and releasing the pressure from the locking pin assembly so that the compression spring moves the cylindrical section into alignment with the opening.

17. A high voltage electrical connector for connecting a cable to a bus bar, the connector comprising:

a crimp barrel having a first end and a second end, wherein the first end is electrically coupled to one of the cable or bus bar and the second end has a tubular neck, wherein the tubular neck has an exterior surface, a first end and a second end connected to the first end of the crimp barrel;

a collar having a threaded interior wall, wherein the collar is slidably and rotatably attached to the tubular neck;

a contact pin having a first end and a second end, wherein the second end is in electrical engagement with the first end of the tubular neck; and a socket having a first end, a second end and a bore extending between the first end and the second end, wherein the first end is electrically coupled to the other of said cable or bus bar, and wherein the socket has an interior surface defined by the bore and the second end has a threaded exterior surface, wherein the connector is assembled by inserting the first end of the contact pin into the bore of the socket, sliding the threaded collar over the threaded exterior surface of the socket and rotating the collar to threadably couple the collar onto the second end of the socket.

18. The high voltage electrical connector according to claim 17, wherein the tubular neck has a retaining ring extending circumferentially around the exterior surface, and wherein the collar rotates freely on the tubular neck and slidably moves between the crimp barrel and the retaining ring.

19. The high voltage electrical connector according to claim 17, wherein the interior surface of the socket has a plurality of flexible louvers.

20. The high voltage electrical connector according to claim 17, wherein the first end of the contact pin is tapered.

* * * * *